US008338734B2

(12) United States Patent
Tao et al.

(10) Patent No.: US 8,338,734 B2
(45) Date of Patent: Dec. 25, 2012

(54) ELECTROSTATIC PARTICLE CHARGER, ELECTROSTATIC SEPARATION SYSTEM, AND RELATED METHODS

(76) Inventors: Dongping Tao, Lexington, KY (US); Xinkai Jiang, Lexington, KY (US)

( * ) Notice: Subject to any disclaimer, the term of this patent is extended or adjusted under 35 U.S.C. 154(b) by 1362 days.

(21) Appl. No.: 10/552,087

(22) PCT Filed: Jun. 2, 2004

(86) PCT No.: PCT/US2004/017292

§ 371 (c)(1),
(2), (4) Date: Oct. 4, 2005

(87) PCT Pub. No.: WO2004/011829

PCT Pub. Date: Feb. 10, 2005

(65) Prior Publication Data

US 2006/0213760 A1 Sep. 28, 2006

Related U.S. Application Data

(60) Provisional application No. 60/477,443, filed on Jun. 10, 2003.

(51) Int. Cl.
*B03C 7/00* (2006.01)

(52) U.S. Cl. ..... 209/127.1; 209/127.4; 209/128; 209/129; 209/130; 204/164

(58) Field of Classification Search ..... 204/164; 209/127.1, 127.4, 128, 129, 130
See application file for complete search history.

(56) References Cited

U.S. PATENT DOCUMENTS

| | | | |
|---|---|---|---|
| 945,917 | A | 1/1910 | Cottrell |
| 1,153,182 | A | 9/1915 | Schniewind |
| 1,221,505 | A | 4/1917 | Bradley et al. |
| 1,361,137 | A | 12/1920 | Chapman et al. |
| 1,558,382 | A | 10/1925 | Marx |
| 1,773,840 | A | 8/1930 | Nattcher et al. |
| 2,119,297 | A | 5/1938 | Scott |
| 2,283,964 | A | 5/1942 | Wyckoff |
| 2,314,940 | A | 3/1943 | Hewitt |
| 2,782,923 | A | 2/1957 | Cook, Jr. |

(Continued)

FOREIGN PATENT DOCUMENTS

| | | |
|---|---|---|
| SE | 508081 | 8/1998 |

(Continued)

OTHER PUBLICATIONS

Heng Ban, "An Experimental Study of Particulate Charge Relating to Electrostatic Dry Coal Cleaning," Dissertation, 1994, pp. 26-27.

*Primary Examiner* — Xiuyu Tai
(74) *Attorney, Agent, or Firm* — King & Schickli, PLLC

(57) ABSTRACT

In one aspect of the invention, a charger for use in a system for separating particles from a fluid flow is disclosed. In one embodiment, the charger comprises a body including an inlet for receiving the particles, a chamber in which the particles are received, and an outlet for discharging the particles. A rotor having a generally non-permeable surface is positioned in the chamber and rotated for contacting and charging the particles. In another aspect of the invention, grid electrodes with elongated fingers are proposed for use in a novel separation system. Related methods of charging and separating particles are also disclosed.

17 Claims, 7 Drawing Sheets

U.S. PATENT DOCUMENTS

| | | | | | |
|---|---|---|---|---|---|
| 3,322,275 | A | | 5/1967 | Breakiron | |
| 3,493,109 | A | | 2/1970 | Carta et al. | |
| 3,744,218 | A | * | 7/1973 | Ebert | 96/49 |
| 3,853,750 | A | | 12/1974 | Volsy | |
| 3,901,799 | A | | 8/1975 | Adkison | |
| 4,072,129 | A | * | 2/1978 | Bright et al. | 239/704 |
| 4,251,234 | A | | 2/1981 | Chang | |
| 4,588,423 | A | | 5/1986 | Gillingham et al. | |
| 4,839,032 | A | | 6/1989 | Whitlock | |
| 4,874,507 | A | | 10/1989 | Whitlock | |
| 5,289,921 | A | | 3/1994 | Rodrigo et al. | |
| 5,397,066 | A | | 3/1995 | Leitman et al. | |
| 5,549,735 | A | | 8/1996 | Coppom | |
| 5,570,789 | A | | 11/1996 | Dunn | |
| 5,591,253 | A | | 1/1997 | Altman et al. | |
| 5,626,652 | A | | 5/1997 | Kohl et al. | |
| 5,755,333 | A | | 5/1998 | Stencel et al. | |
| 5,938,041 | A | | 8/1999 | Stencel et al. | |
| 5,938,818 | A | | 8/1999 | Miller | |
| 6,004,375 | A | | 12/1999 | Gutsch et al. | |
| 6,034,342 | A | | 3/2000 | Schmoutziguer et al. | |
| 6,072,140 | A | | 6/2000 | Miller | |
| 6,271,492 | B1 | | 8/2001 | Maehata et al. | |
| 6,320,148 | B1 | * | 11/2001 | Yoon et al. | 209/127.3 |
| 6,415,929 | B1 | | 7/2002 | Maehata et al. | |
| 6,426,474 | B1 | * | 7/2002 | Maehata et al. | 209/127.1 |
| 6,498,313 | B1 | * | 12/2002 | Stencel et al. | 209/131 |
| 6,720,514 | B1 | * | 4/2004 | Inoue et al. | 209/128 |
| 6,797,908 | B2 | * | 9/2004 | Yan et al. | 209/131 |
| 2002/0085977 | A1 | * | 7/2002 | Fotland et al. | 424/45 |
| 2003/0192813 | A1 | | 10/2003 | Yan et al. | |

FOREIGN PATENT DOCUMENTS

| | | | |
|---|---|---|---|
| SU | 1085633 | | 4/1984 |
| WO | WO 85/02355 | | 6/1985 |
| WO | WO 00/56462 | | 9/2000 |
| WO | WO00/76669 | * | 12/2000 |
| WO | WO 01/21318 | * | 3/2001 |

* cited by examiner

ELECTROSTATIC PARTICLE CHARGER, ELECTROSTATIC SEPARATION SYSTEM, AND RELATED METHODS

This application claims the benefit of U.S. Provisional Patent Application Ser. No. 60/477,443 Jun. 10, 2003, the disclosure of which is incorporated herein by reference.

TECHNICAL FIELD

The present invention relates to the material separation art and, more particularly, to an improved particle charger or charging device, an improved separator, and related methods for electrostatically separating two species of particles from a particle mixture.

BACKGROUND OF THE INVENTION

"Dry" triboelectrostatic separation is widely used as an effective technique for separating different particulate solid components ("particles") from a physical mixture entrained or carried in a driving fluid, such as air. Typical applications include the beneficiation of minerals, purification of foods, the recovery of valuable components from waste, and the sizing of particles in a particle mixture. This technology has gained widespread acceptance as providing a low cost, environmentally friendly technique, since it requires no chemicals or water and thus eliminates costly downstream de-watering and slime disposal applications required in wet separation processes.

Typically, electrostatic separation relies on the surface physical properties of the different particles and controlled flow conditions to effect beneficiation in an efficient and effective manner. Specifically, when two species of particles with different work functions contact one another, a charge transfer between the contact area results, such that one species may carry a positive charge and the other a negative charge (known as "contact charging"). This differential charge may also be achieved by "friction charging," which results when the particles are forced to slide along or rub against a solid surface. The combined effects of these charges are together known as "triboelectrostatic charging" or "tribo-charging" for short, and are together considered to play a key role in achieving particle separation.

FIG. 1 schematically illustrates a typical prior art triboelectrostatic separator S. The particles P in the mixture are fed into the separator S from a bin B, and are charged to a bipolar state in a metal tube T, mainly by friction charging. The particles P then pass through an electric field F, such that the species of particles having a particular charge is drawn from the mixture toward a corresponding electrode $E_1$, $E_2$. However, as a result of the inefficient charging resulting from the fact that not all particles make contact with the sidewalls of the tube T, weakly charged or charge-neutral particles may not be attracted and consequently simply pass through the separator S unaffected by the electric field F. While these "middling" particles (not shown in FIG. 1) may be separated during a second pass, this obviously decreases the efficiency of the separation operation. Increasing the feed rate of the particles P may allow for more passes in a shorter period, but a concomitant decrease in the separation efficiency per pass results because of the shorter residence time of the particles in the electric field F.

Accordingly, while the typical prior art separator S is effective for separating two particle species from a particle mixture, it should be appreciated that further improvements in separation effectiveness and operational efficiency are still possible. More specifically, a need exists for devices and methods that enhance the charging on the particles as well as the downstream separation to improve efficiency and potentially reduce the need for the number of passes required.

SUMMARY OF THE INVENTION

In accordance with a first aspect of the invention, an apparatus for intended use in charging particles in a system for separating particles from a fluid flow is disclosed. The apparatus comprises: (1) a chamber including an inlet for receiving the particles and an outlet for discharging the particles; and (2) a rotor rotatably mounted in the chamber. The rotor has a generally non-permeable outer surface for contacting and assisting in charging the particles.

In one particular embodiment, the rotor is circular, polygonal, or gear-shaped in cross-section, and the chamber is generally cylindrical. Preferably, the outlet of the chamber is positioned below and generally opposite the inlet. A partition may also project into the chamber adjacent the rotor. Preferably, the partition is adjustable to vary the distance between an end of the partition and the rotor. Additionally, a motor is provided for rotating the rotor. The motor may rotate the rotor at a rotational speed of up to 10,000 revolutions per minute.

In the same or another embodiment, an electric field is provided in the chamber. Preferably, the electric field is created by a variable voltage source having a first lead connected to the rotor and a second lead connected to a wall of the chamber. The electric field helps to enhance the charging of certain types of particles.

In accordance with a second aspect of the invention, an apparatus for intended use in separating particles of a mixture is disclosed. The apparatus comprises a body including an inlet for receiving the electrically charged particles to be separated, a separation chamber, a first electrode for attracting particles having a first selected charge, and a second electrode for attracting particles having a second selected charge. The first and second electrodes are grid electrodes having a plurality of elongated fingers extending along the separation chamber spaced apart from the body. A flow straightener positioned in or adjacent to the inlet receives and straightens a co-flow of fluid, such as a gas, passing over and between the fingers of the grid electrodes for carrying or sweeping away the particles.

In one embodiment of the separation apparatus, a variable voltage source applies a positive voltage potential to the first electrode and a negative voltage potential to the second electrode. Preferably, the fingers on each electrode are connected to a common header.

In accordance with a third aspect of the invention, a method of separating particles from a particle mixture is disclosed. The method comprises actuating a rotor to create a differential charge on the two or more constituent species of particles in the mixture and separating the differentially charged particles into the two or more constituent species at a location downstream of the chamber. Preferably, the actuating step is accomplished by rotating the rotor at a speed of at least 1,200 revolutions per minute.

In accordance with a fourth aspect of the invention, a method for separating electrostatically charged particles from a mixture is disclosed. The method comprises introducing the charged particles to a separation chamber including a positive grid electrode for attracting negatively charged particles and a negative grid electrode for attracting positively charged particles; and sweeping away corresponding particles from the grid electrodes using a straightened co-flow of a fluid, such as a gas. The step of actuating a rotor in a mixing chamber upstream of the separation chamber to enhance the charge on the particles in the mixture may also be performed.

BRIEF DESCRIPTION OF THE DRAWING FIGURES

FIG. 1 schematically illustrates a prior art separation system;

Figure 2:
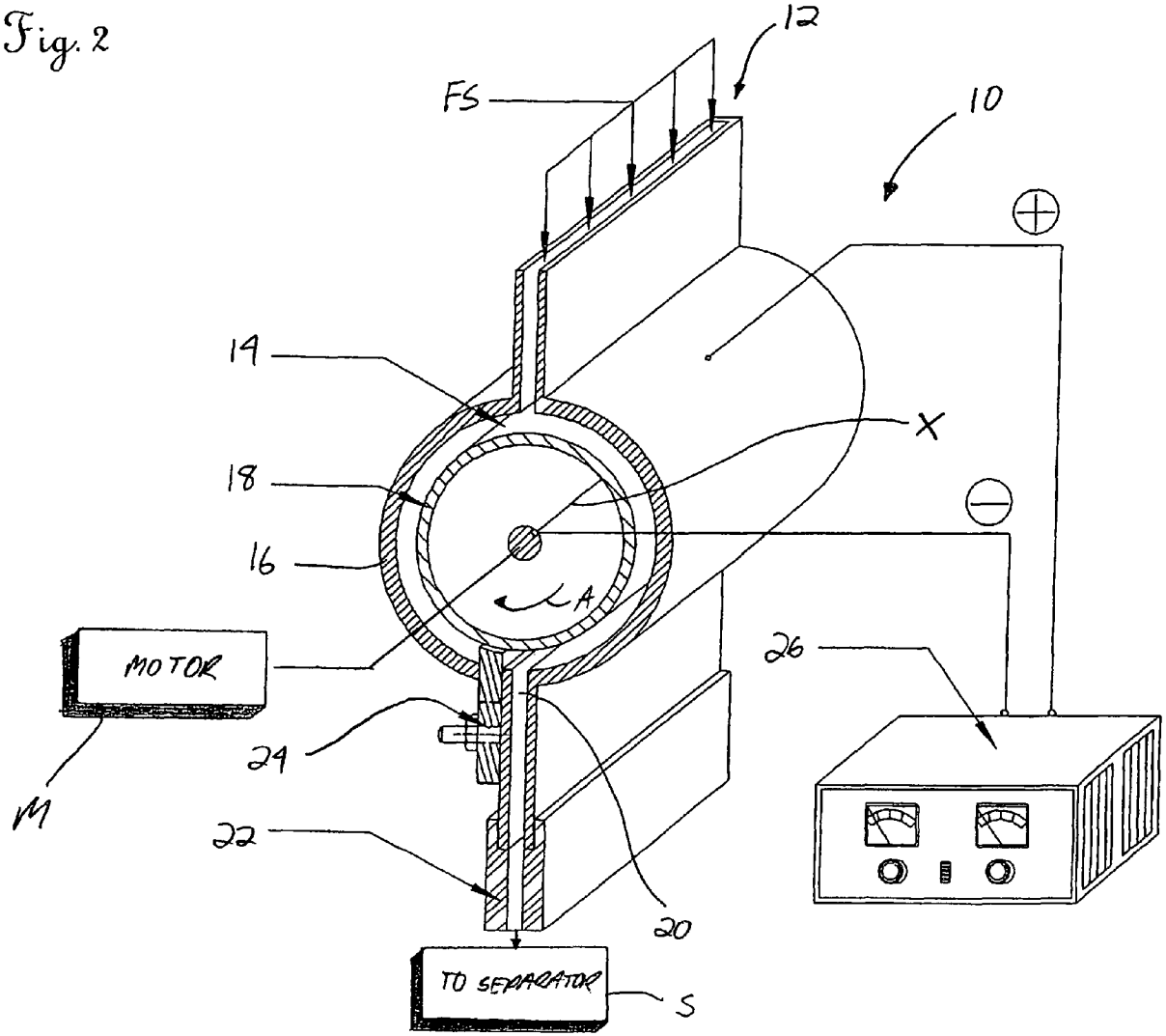
FIG. 2 is a partially cross-sectional, perspective view of one embodiment of the charger forming one aspect of the invention.
Figure 4A:
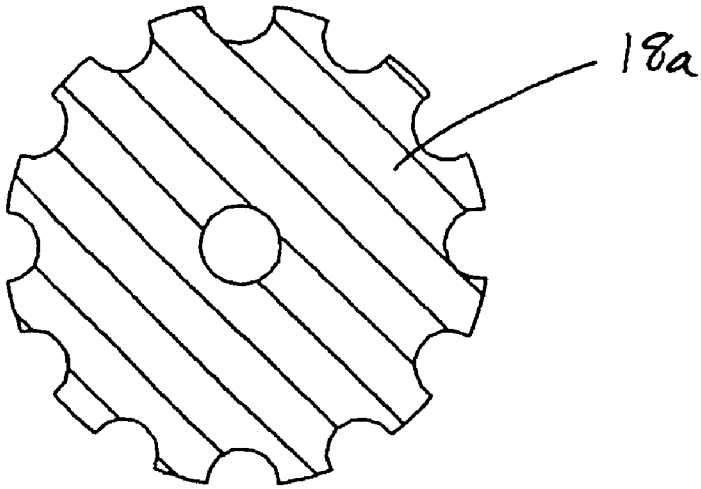
Figure 4B:
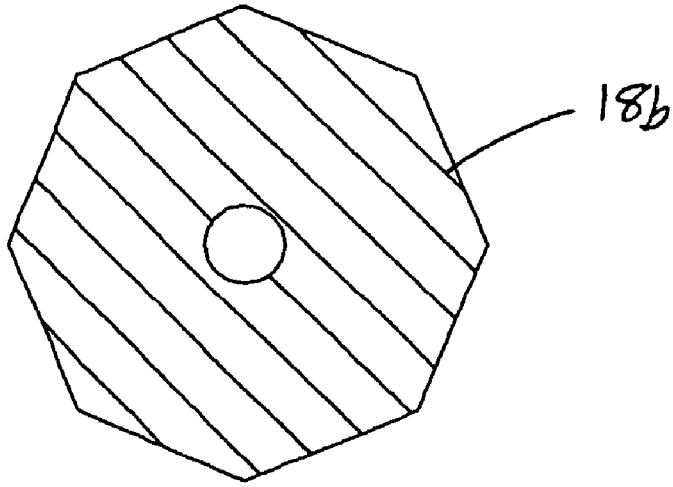
Figure 4C:
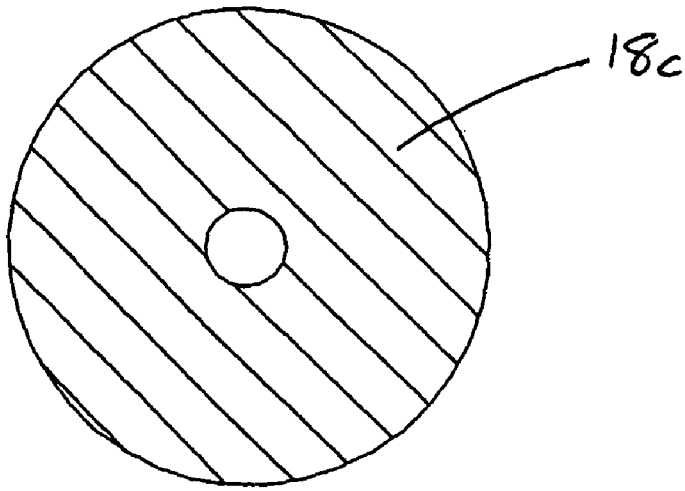
Figure 5:
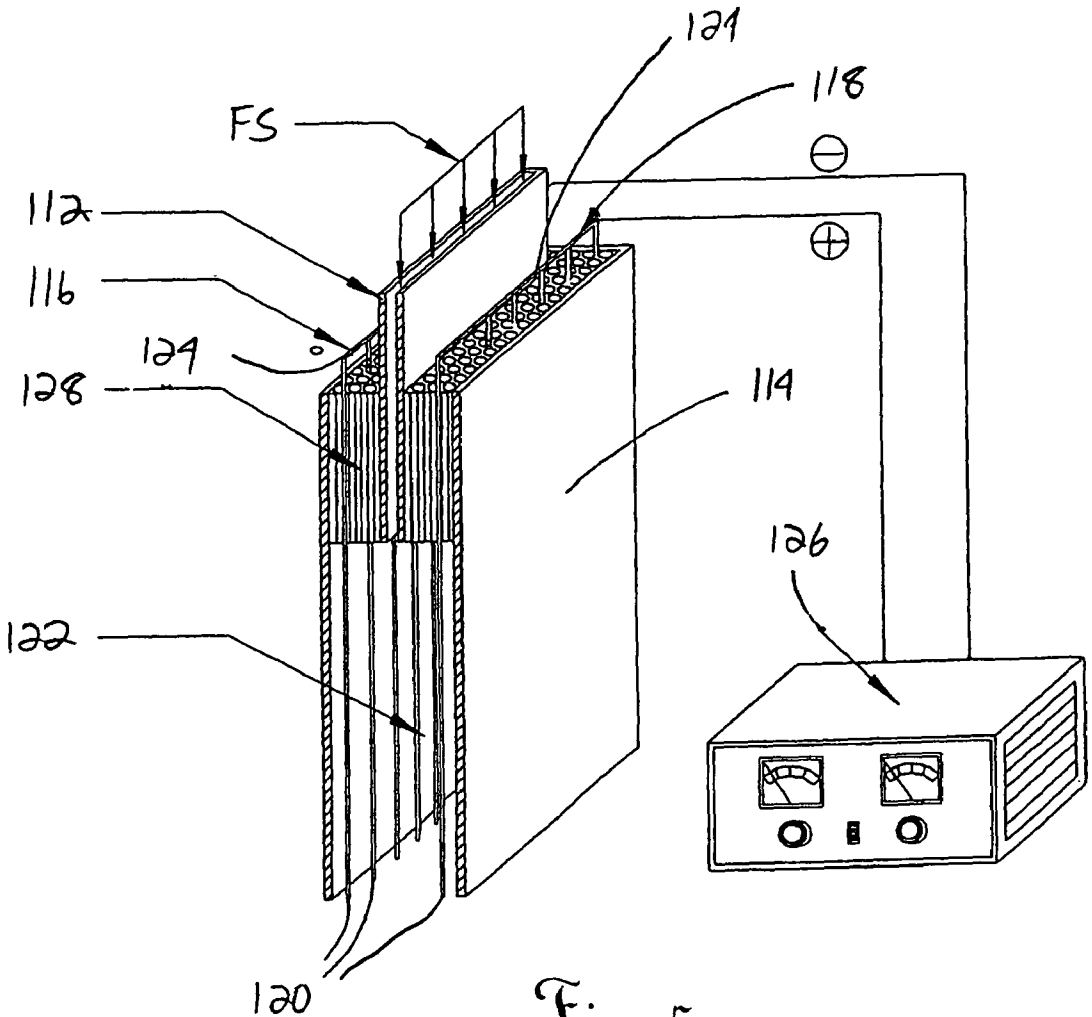
Figure 6B:
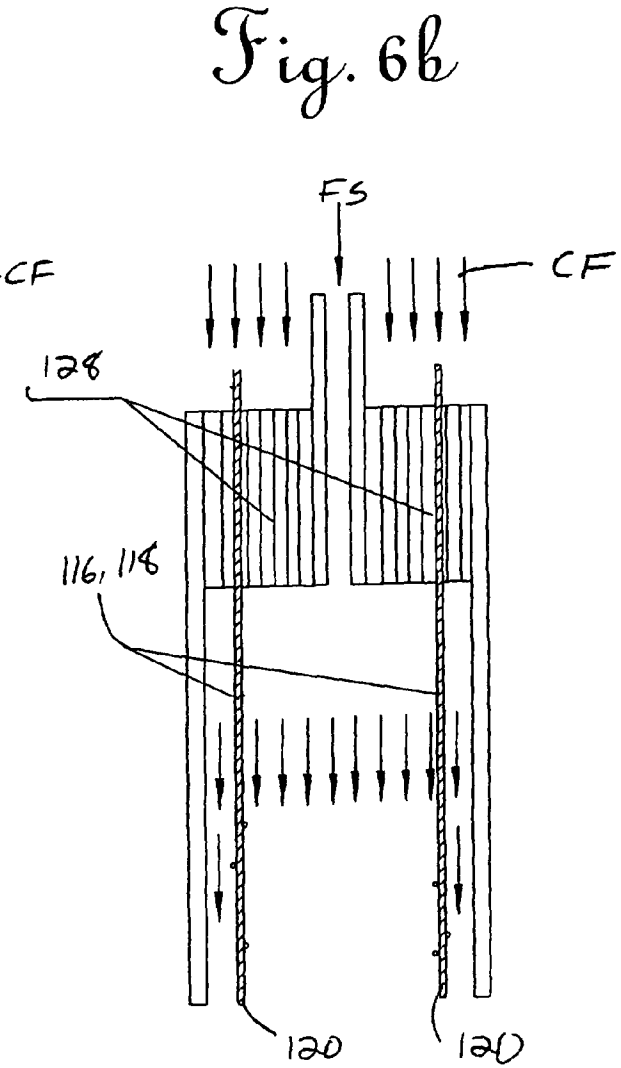
Figure 6A:
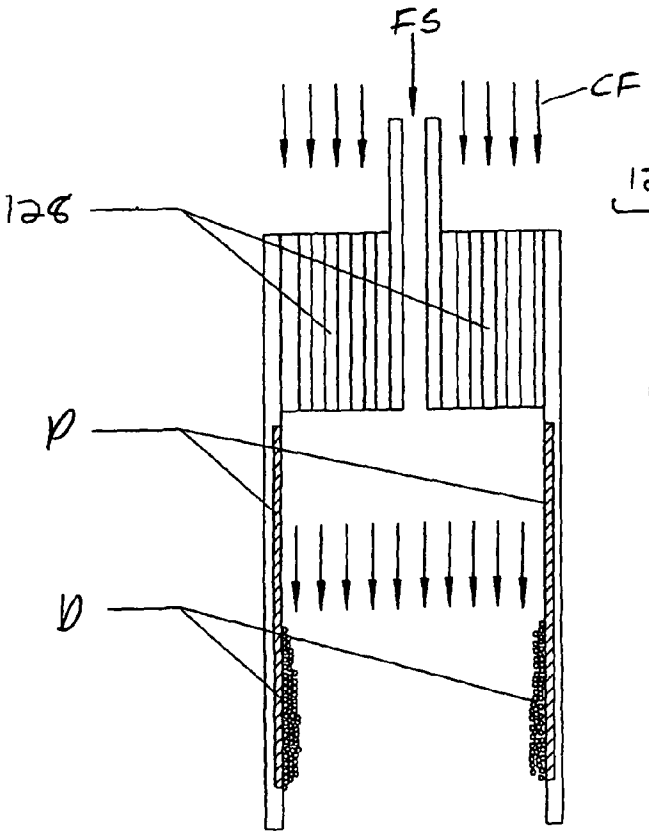
Figure 7:
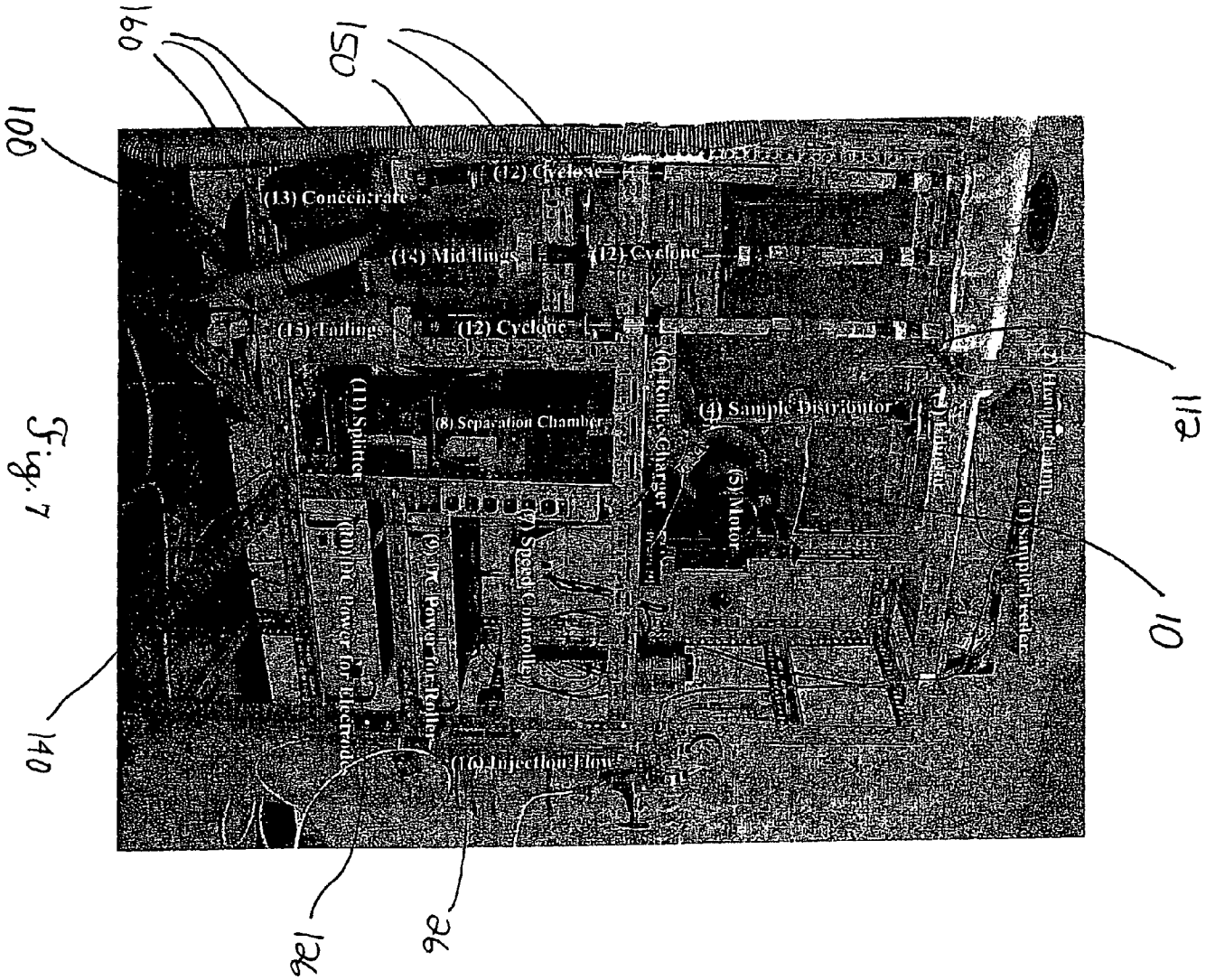

FIGS. 4*a*-4*c* show exemplary shapes of rotors;

FIG. 5 is a partially cross-sectional, perspective view of one embodiment of the separator forming another aspect of the invention;

FIGS. 6*a* and 6*b* are schematic side views of the separator of FIG. 5 in operation; and FIG. 7 illustrates an experimental set-up using the charger of FIG. 2 and the separator of FIG. 5.

DETAILED DESCRIPTION OF THE INVENTION

With reference to the partially schematic, cross-sectional side view of FIG. 2, and in accordance with a first aspect of the invention, an improved particle charging device or charger 10 is disclosed. The charger 10 includes a generally rectangular, elongated inlet 12 for receiving a feed stream FS, which may include a mixture comprised of at least two species of particles to be differentially charged. Particles in the feedstream (which includes at least a small amount of a driving fluid, such as air) passing through the distributor are introduced to the inlet 12 and enter a charging chamber 14 forming part of the charger 10.

The charging chamber 14 is formed between the inner surface of an outer wall 16 and the outer surface of a charging roller or rotor 18 mounted to rotate about an axis of rotation X, and thus creates an annular space for receiving the particle mixture. The roller or rotor 18 is provided with a generally continuous, non-permeable outer surface for contacting and frictionally charging the particles in the mixture (which typically have a size ranging from 2-3 millimeters or less).

An outlet 20 is defined in the outer wall 16 of the charger 10 generally opposite the inlet 12. The outlet 20 may be in direct or indirect communication with a downstream separator or like device for effecting further processing of the particle mixture. A plastic adaptor 22 may also be connected to the outlet 20 for receiving and containing the particle mixture as it transitions to the downstream separator S. To increase the throughput without compromising efficiency, the charger 10 and all components forming it are elongated in a direction aligned with the axis of rotation of the rotor 18 (which is shown as being hollow and having a center support shaft (not numbered) in operative engagement at one end with a motor M).

In one possible mode of operation, the rotor 18 is rotated at a selected rotational speed (e.g., up to 10,000 rpm, and more preferably between 1,200 and 8,000 rpm) by the motor M (which may be a variable speed electric motor). Particles encountering the rotor 18 upon passing through the inlet 12 become agitated and charged by both friction and contact charging. More particularly, the dynamic agitation of the mixture created by the rotation of the rotor 18 increases the incidence of both: (1) particle-particle contact, thus creating contact charging; and (2) particle-wall contact (either the outer wall 16 or with the surface of the rotor 18), thus creating friction charging. In other words, the particles in the mixture will have multiple areas of contact, both with the rotor 18 and the other particles, due to the fast rotation and agitation of the particles created thereby. As a result of using this "rotary charger," a much higher charge density on the surface of the particles results, and the incidence of weakly or neutrally charged particles passing through the outlet 20 is reduced.

Figure 1:
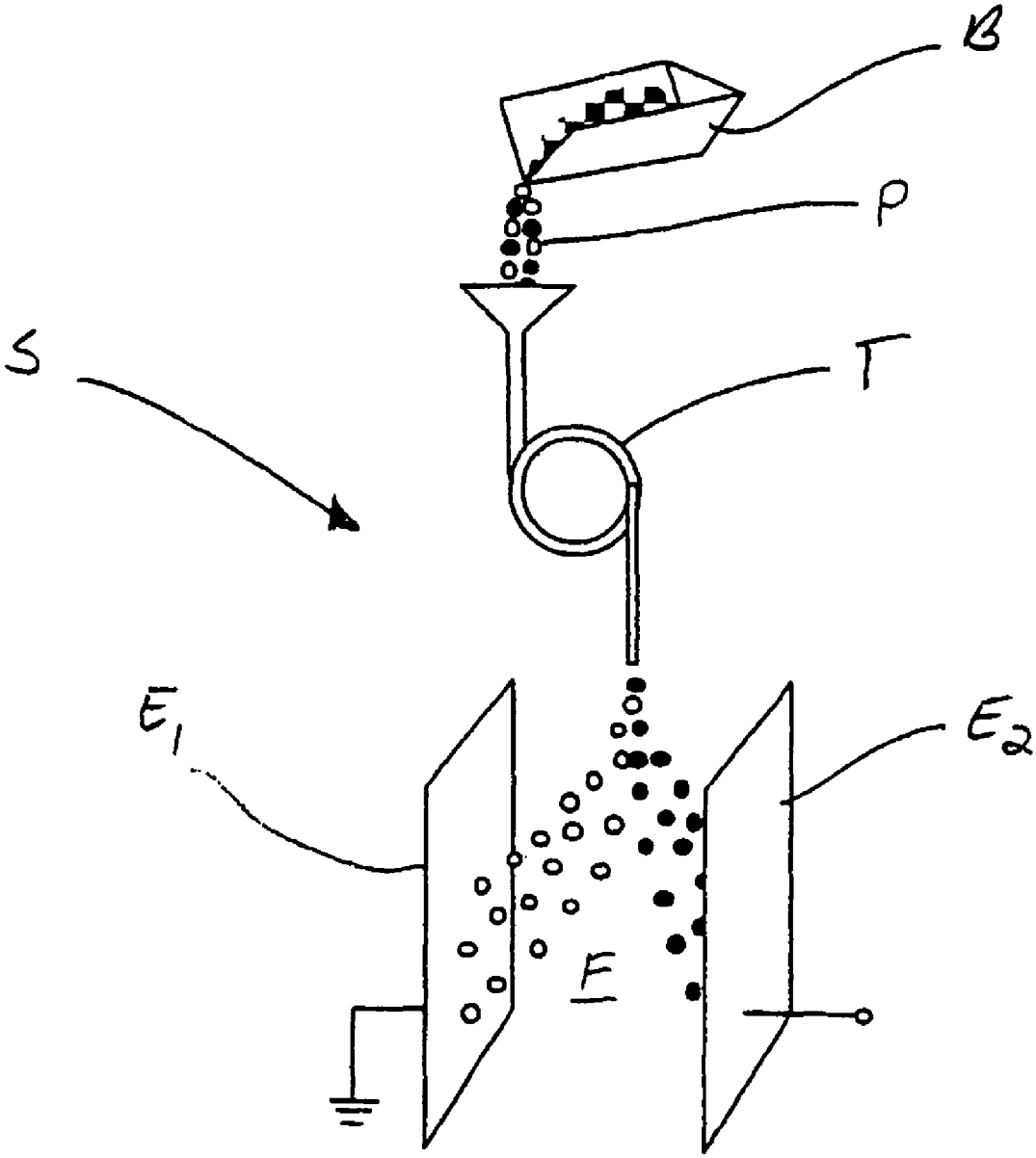
Fig. 1 (Prior Art)

When the particles passing through the charger 10 are fed to a downstream separator S, separation efficiency is increased (possibly by as much as 40%) and the need for multiple passes to effect separation may be eliminated. The active charging provided by the charger 10 also allows for a much higher throughput without reducing the separation efficiency, as compared to the passive charging afforded by the tube-type of arrangement shown in FIG. 1. The charger 10 also helps to ensure that all particles are charged, not just a mono-layer of particles at the surface of the mixture (as is the case of a corona charger).

The charger 10 may also operate in a continuous fashion such that particles fed through the inlet are constantly being charged and discharged through the outlet for downstream separation. However, the provision of a closure or door adjacent the outlet 20 is a possibility, including in the case where the operation of the charger is separate from the downstream operation. In other words, the charging may be completed apart from the separation, the two may occur simultaneously on the same batch of the particle mixture, or the two may occur simultaneously on two different batches of the particle mixture.

FIG. 2 also illustrates that a partition 24 may also be provided for selective insertion into the chamber 14 to perform the dual function of preventing the particle mixture from prematurely entering the outlet 20 in one direction and guiding the particle mixture to the outlet in the other. The partition 24 may pass through an opening in the outer wall 16, preferably adjacent to the opening defined by the outlet 20 through which the particle mixture exits the chamber 14, and its inner end extends to a point closely adjacent to the outer surface of the rotor 18. This inner end of the partition 24 may have an upper face matching the contour of the rotor (e.g., an arcuate face, in the case where the rotor is cylindrical)). The partition 24 may be mounted directly to the wall defining the outlet 20 using a fastener (FIG. 2), and may optionally be mounted to permit selective adjustment of the inner end toward or away from the rotor 18.

When the rotor 18 rotates in the clockwise direction as viewed in FIG. 2 (note action arrow A), the partition 24 is thus positioned downstream of the outlet 20 in the angular sense. In this position, it serves to prevent or block particles from simply falling through the outlet 20 without making contact with the surface of the rotor 18 or the inside surface of the outer wall 16. The partition 24 so positioned also prevents lighter particles from becoming permanently suspended in the fluid flow surrounding the rotor 18 during rotation, since it contacts and forces the particles into the outlet 20 and toward the downstream separator. As should be appreciated, when the direction of rotation is reversed, the position of the partition 24 relative to the outlet 20 may be likewise reversed to accomplish the intended blocking and guiding functions.

Figure 3:
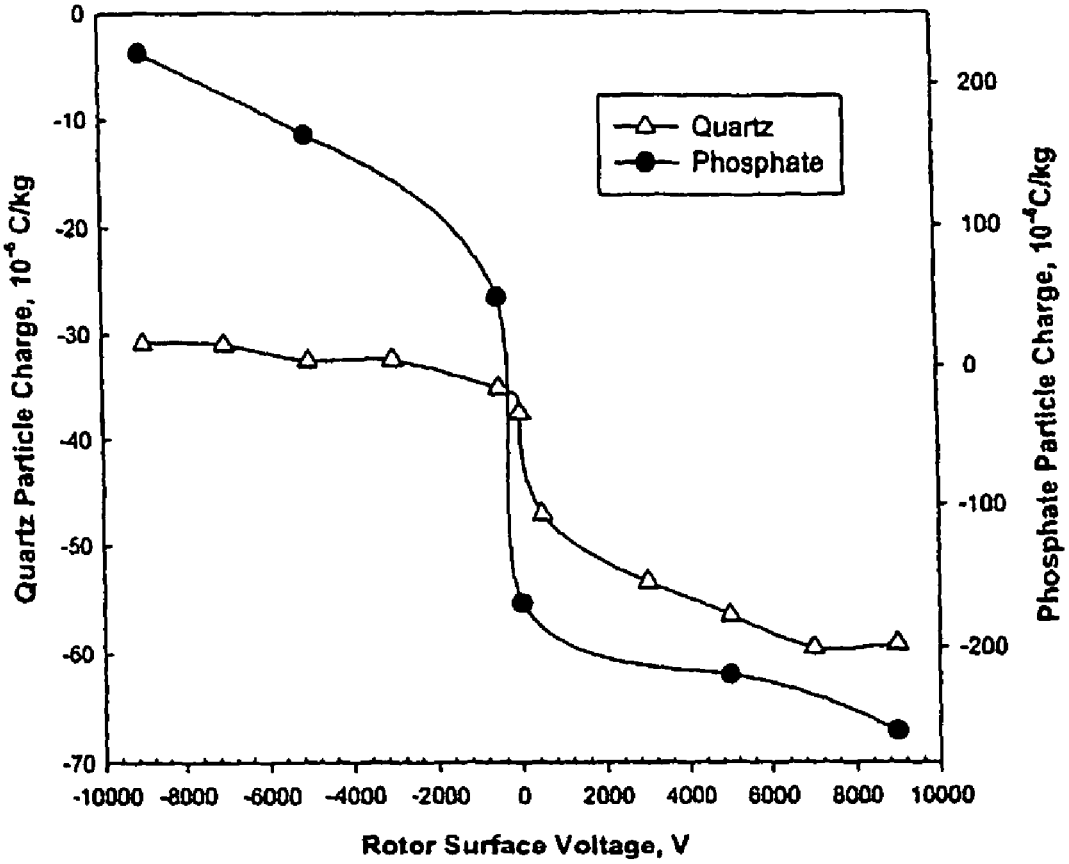
FIG. 3 is a graph illustrating the enhanced particle charging achieved when an electric field is applied to the charger.

Selective charging may further be enhanced by applying an electric field to the charger 10. Specifically, as shown in FIG. 2, the leads of an external voltage source 26 are applied to the rotor 18 and the outer wall 16 of the chamber 14 to create an electric field therein. Using this externally applied voltage may allow for a certain charge density and polarity to be achieved on the particles. For example, as graphically illustrated in FIG. 3, using a typical phosphate and quartz mixture, the phosphate may be charged over a range of $500\times10^{-6}$ C/kg (from about positive $250\times10^{-6}$ C/kg to negative $250\times10^{-6}$ C/kg) while the quartz is always charged negatively when the external applied voltage is in the range of −9 kV to +9 kV. At zero voltage, both the phosphate and quartz are charged negatively. Therefore, separation of phosphate from quartz is more efficient if an external voltage is applied.

Although a generally cylindrical rotor 18 is shown in FIG. 2, it should be appreciated that other shapes may be used (and that such shapes may further enhance the charging of the particles). An example of a gear or sprocket-wheel type of rotor 18*a* with outwardly projecting "teeth" and corresponding surface indentations is shown in FIG. 4*a*. An octagonal rotor 18*b* is shown in FIG. 4*b*, which thus provides a plurality (eight) of distinct contact surfaces. Other polygonal shapes could also be used (e.g., a hexagon or dodecagon), with or without rounded corners at the intersections of the planar surfaces. FIG. 4*c* also shows that a cylindrical separator 18*c* may be formed as a solid body, as compared to the hollow body 18 shown in FIG. 2. In both cases, the outer surface of the rotor 18 remains non-permeable or continuous.

In accordance with another aspect of the invention, an improved separator 100 is also disclosed. The separator 100 includes a distributor 112 defining an inlet for receiving a feedstream of charged particles (which as should be appreciated may be delivered from the outlet 20 of the charger 10 described above or a different device, including the conventional tube T shown in FIG. 1). The particles are delivered to a body 114 of the separator 100, which is generally rectangular and elongated. The driving fluid (gas) may be supplied by a driving fluid source, such as a forced draft fan (not shown), positioned upstream of the distributor 112. The fluid or gas is preferably ambient air, but other gases such as nitrogen, helium, argon, carbon dioxide, or combustion flue gas can be used at temperatures between approximately 25° C. to 300° C.

In typical separators using plate-type electrodes (see FIG. 1), the deposition of charged particles may reduce the separation efficiency and require deleterious periodic shutdowns for cleaning. In an effort to reduce or eliminate the need for such shutdowns, a pair of grid or grill electrodes 116, 118 are positioned in the body 114, spaced from the sidewalls thereof. Each grid electrode 116, 118 is comprised of a plurality of elongated, generally parallel fingers 120 that extend into and define a separation chamber 122 within the body 114. The fingers 120 each emanate from a common header 124 and a similar footer (not shown) may also be provided to enhance the rigidity and stability of the electrodes 116, 118. The elongated, spaced nature of the fingers 120 eliminates or substantially reduces the amount of particles deposited on the electrodes 116, 118, which obviates the above-mentioned problems.

Each electrode 116, 118 is connected to the lead of a variable voltage source 126 (such as along the header 124) to create an electric field in the chamber 122 for separating the particles having a selected charge. A co-flow of gas devoid of particles may also be introduced from a separate source (not shown) for sweeping away the particles drawn towards the electrodes 116, 118. Preferably, flow straighteners 128 are provided to reduce the turbulence and form a smooth co-flow of gas generally parallel to the feedstream FS upon entering the separation chamber 122. The flow straighteners 128 may be in the form of tubes having aspect ratios, i.e., the ratio of length to diameter, of greater than 20:1, but other types of straighteners (such as vanes) may also be used.

FIGS. 6*a* and 6*b* schematically demonstrate a comparison between the use of plate electrodes P (FIG. 6*a*) and the grill or grid electrodes 116, 118 (FIG. 6*b*). In FIG. 6*a*, the deposit D of particles on the plate electrodes P is shown. Since the flow of both the feedstream FS of charged particles and the co-flow CF devoid of particles passes only over the opposed faces of the plate electrodes P, the particles drawn from the mixture accumulate and form the deposits D. However, in the case of the grid electrodes 116, 118 (which are spaced from at least two adjacent sidewalls of the body 114, and preferably all four), the flows essentially surround the fingers, moving both over and between them. This helps to prevent the particles from accumulating and forming the undesirable deposits that hamper efficient operation.

FIG. 7 shows an experimental set-up built and used to demonstrate the effectiveness of the charger 10 and separator 100 disclosed herein when used in combination. As is known in the art, the system may include a splitter 140 downstream of the separator for dividing the flow into streams including the substantially separate and pure species of particles and cyclones 150 or other filtering devices for removing the particles from the streams once separated. Collection bins 160 may also be provided for collecting the first and second species of particles, as well as any "middlings" that result.

Experiments were conducted using the exemplary system 100 shown in FIG. 7 in an effort to demonstrate the efficacy of the charger 10 Both one-stage and two-stage separation was employed. Using this set-up, the following sets of data were obtained using both one-stage and two-stage separation:

EXAMPLE 1

Fly Ash Separation Result

TABLE 1

One-stage fly ash separation

| | Ash | | Middling | | Tailing | |
|---|---|---|---|---|---|---|
| # | LOI, % | Yield | LOI, % | Yield | LOI, % | Yield |
| #1 | 0.75 | 44.57 | 1.92 | 43.30 | 4.31 | 12.13 |
| #2 | 0.94 | 59.92 | 7.49 | 25.62 | 39.19 | 14.46 |
| #3 | 1.19 | 33.87 | 2.82 | 38.09 | 15.98 | 28.04 |
| #4 | 1.21 | 42.08 | 5.37 | 45.82 | 28.47 | 12.10 |
| #5 | 3.64 | 43.41 | 14.93 | 39.22 | 41.44 | 17.37 |

EXAMPLE 2

Fly Ash Separation Result

TABLE 2

Two-stage fly ash separation

| Product Ash, % | ΣProduct Ash, % | Product Yield, % | ΣProduct Yield, % | ΣAsh Recovery, % |
|---|---|---|---|---|
| 0.23 | 0.23 | 36.01 | 36.01 | 38.85 |
| 1.04 | 0.48 | 15.58 | 51.59 | 55.52 |
| 3.58 | 0.72 | 4.48 | 56.06 | 60.18 |
| 6.04 | 1.31 | 6.90 | 62.96 | 67.19 |
| 7.12 | 1.67 | 4.20 | 67.16 | 71.41 |
| 9.64 | 3.11 | 14.85 | 82.01 | 85.92 |
| 13.03 | 3.73 | 5.45 | 87.45 | 91.04 |
| 27.13 | 4.50 | 2.98 | 90.43 | 93.38 |
| 30.84 | 5.94 | 5.24 | 95.67 | 97.30 |
| 42.38 | 7.52 | 4.34 | 100.00 | 100.00 |

EXAMPLE 3

Coal Cleaning Result

TABLE 3

| Coal cleaning | | | | | |
|---|---|---|---|---|---|
| Product Ash, % | ΣProduct Ash, % | Product Yield, % | ΣProduct Yield, % | ΣCombustible Recovery, % | ΣAsh Rejection, % |
| 3.44 | 3.44 | 42.40 | 42.40 | 49.56 | 91.61 |
| 7.82 | 4.84 | 19.94 | 62.34 | 71.81 | 82.64 |
| 26.92 | 9.07 | 14.75 | 77.10 | 84.86 | 59.78 |
| 37.89 | 13.02 | 12.24 | 89.34 | 94.06 | 33.09 |
| 53.96 | 17.38 | 10.66 | 100.00 | 100.00 | 0.00 |

Table 3 shows the results of coal cleaning obtained by a two-stage closed circuit test. The raw coal ash content is about 17%. For the product with 9.07% ash, an 84.86% of combustible recovery can be achieved with an ash rejection of 59.78%.

EXAMPLE 4

Ground Calcium Carbonate Separation Result

TABLE 4

| Separation results on ground calcium carbonate (GCC) | | | | | |
|---|---|---|---|---|---|
| | Insoluble % | ΣInsoluble % | Yield % | ΣYield % | ΣRecovery % |
| One-Stage | 0.50 | 0.50 | 40.70 | 40.70 | 41.99 |
| | 3.00 | 1.88 | 50.10 | 90.79 | 92.39 |
| | 20.30 | 3.58 | 9.21 | 100.00 | 100.00 |
| | | | 100.00 | | |
| Two-Stage | 0.10 | 0.10 | 14.61 | 14.61 | 15.11 |
| | 0.50 | 0.33 | 19.61 | 34.22 | 35.31 |
| | 0.50 | 0.39 | 19.20 | 53.42 | 55.09 |
| | 1.80 | 0.50 | 4.34 | 57.76 | 59.51 |
| | 2.50 | 1.16 | 28.31 | 86.07 | 88.09 |
| | 6.40 | 1.35 | 3.37 | 89.43 | 91.35 |
| | 12.50 | 1.83 | 3.99 | 93.42 | 94.96 |
| | 16.60 | 2.54 | 4.71 | 98.13 | 99.03 |
| | 49.90 | 3.42 | 1.87 | 100.00 | 100.00 |
| | | | 100.00 | | |

As shown in Table 4, efficient removal of silica from the ground calcium carbonate (GCC) was achieved with the triboelectrostatic separation technology. A two-stage separation produced better separation results than the one-stage separation. Based on the two-stage separation, approximately 34% of calcium carbonate can be recovered for a product with 0.3% insol; a 57% yield of calcium carbonate is expected for a product with 0.5% insoluble.

EXAMPLE 5

Phosphate Separation Result

TABLE 5

| Two-stage separation on phosphate flotation feed | | | | |
|---|---|---|---|---|
| $P_2O_5$ % | $\Sigma P_2O_5$ | Yield % | ΣYield | $\Sigma P_2O_5$ Recovery % |
| 36.64 | 36.64 | 5.15 | 5.15 | 32.35 |
| 17.32 | 23.48 | 11.00 | 16.14 | 65.03 |
| 14.42 | 21.48 | 4.55 | 20.70 | 76.29 |
| 12.96 | 19.99 | 4.40 | 25.09 | 86.06 |
| 3.21 | 13.82 | 14.58 | 39.67 | 94.08 |
| 1.99 | 12.26 | 6.03 | 45.70 | 96.14 |
| 1.01 | 10.47 | 8.64 | 54.34 | 97.64 |
| 0.36 | 7.23 | 25.68 | 80.02 | 99.23 |
| 0.22 | 5.83 | 19.98 | 100.00 | 100.00 |

Two-stage separation was conducted on a phosphate sample (Table 5), which is the flotation feed. Two fractions containing less than 0.5% $P_2O_5$ with 45% yield exist. A concentrate with 36.64% $P_2O_5$ can be produced with 32.35% $P_2O_5$ recovery.

The foregoing descriptions of various embodiments of the invention are provided for purposes of illustration, and are not intended to be exhaustive or limiting. Modifications or variations are also possible in light of the above teachings. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. An apparatus for intended use in charging particles in charging particles in a particle mixture as part of a system for separating particles from a feedstream comprising a fluid flow including the particle mixture, comprising:

a tribocharging rotor of a generally cylindrical shape, said rotor having a generally continuous, non-permeable outer surface for contacting and frictionally charging the particles of the particle mixture;

a chamber at least partially defined by an outer wall and the rotor, said chamber including an inlet for receiving the particle mixture and an outlet for discharging the particle mixture, wherein the rotor is mounted within the chamber along an axis of rotation;

a partition passing through an opening in the outer wall of the chamber and projecting into the chamber adjacent the outlet, said partition having a free end facing the generally continuous, non-permeable outer surfaceof the rotor, and said partition performing the dual function of preventing the particle mixture from prematurely entering the outlet in one direction and guiding the particle mixture to the outlet in the other direction; and an electric field in the chamber for enhancing the charging of the particles.

2. The apparatus of claim 1, wherein the axis of rotation is horizontal.

3. The apparatus of claim 1, wherein the free end of the partition further includes an upper face matching a contour of the rotor.

4. The apparatus according to claim 1, wherein the rotor is elongated in a direction transverse to a path of travel of the particle mixture from the inlet to the outlet.

5. The apparatus according to claim 1, wherein the chamber defines a generally open space between an outer surface of the rotor and the outer wall of the chamber for receiving the particle mixture.

6. The apparatus according to claim 1, wherein the outlet is positioned below and generally opposite the inlet, whereby the particle mixture travels in a generally downward path from the inlet to the outlet.

7. The apparatus according to claim 1, wherein the partition is adjustable to vary the distance between the free end of the partition and the rotor.

8. The apparatus according to claim 1, wherein the rotor rotates at a rotational speed of between about 1,200 and 10,000 revolutions per minute.

9. The apparatus according to claim 1, wherein the electric field is created by a variable voltage source having a first lead connected to the rotor and a second lead connected to a wall of the chamber.

10. A particle separation system including a feedstream for delivering the particle mixture to the inlet of the apparatus of claim 1, and an electrostatic separator for receiving the particle mixture from the outlet and separating at least one species of particles from the particle mixture.

11. An apparatus for intended use in charging particles in a particle mixture as part of a system for separating particles from a feedstream comprising a fluid flow including the particle mixture, comprising:

a tribocharging rotor of a generally cylindrical shape, said rotor having a generally continuous, non-permeable outer surface for contacting and frictionally charging the particles of the particle mixture;

a chamber at least partially defined by an outer wall and the rotor, said chamber including an inlet for receiving the particle mixture and an outlet for discharging, the particle mixture, wherein the rotor is mounted within the chamber along an axis of rotation;

means for both preventing the particle mixture from prematurely entering the outlet in one direction and also for guiding the particle mixture, toward the outlet in the other direction; and an electric field in the chamber for enhancing the charging of the particles.

12. The apparatus of claim 11, wherein the preventing and guiding means is a partition which passes through an opening in the outer wall of the chamber and projects into the chamber adjacent the outlet, said partition having a free end facing the generally continuous, non-permeable outer surface of the rotor.

13. The apparatus according to claim 12, wherein the partition is adjustable to vary the distance between the free end of the partition and outer surface of the rotor.

14. The apparatus according to claim 11, further including a motor for rotating the rotor.

15. The apparatus according to claim 11, further including a variable voltage source having a first lead connected to the rotor and a second lead connected to the wall of the chamber.

16. A particle separation system including a feedstream for delivering the particle mixture to the inlet of the apparatus of claim 11 and an electrostatic separator for receiving the particle mixture from the outlet and separating at least one species of particles from the particle mixture.

17. The system of claim 16, wherein the separator includes a second electric field.

* * * * *